US006997589B2

(12) United States Patent
Cibie

(10) Patent No.: US 6,997,589 B2
(45) Date of Patent: Feb. 14, 2006

(54) MASKING DEVICE FOR AUTOMOBILE VEHICLE HEADLIGHTS

(76) Inventor: Pierre Cibie, 145 Avenue du Roule, Neuilly sur Seine (FR) 92200

( * ) Notice: Subject to any disclaimer, the term of this patent is extended or adjusted under 35 U.S.C. 154(b) by 44 days.

(21) Appl. No.: 10/397,361

(22) Filed: Mar. 27, 2003

(65) Prior Publication Data

US 2004/0145911 A1 Jul. 29, 2004

Related U.S. Application Data

(63) Continuation-in-part of application No. 10/351,429, filed on Jan. 27, 2003, now abandoned.

(51) Int. Cl.
*F21V 5/00* (2006.01)

(52) U.S. Cl. ..... 362/520; 362/539; 362/311; 362/331

(58) Field of Classification Search ..... 362/520–522, 362/511, 299, 300, 308, 326, 539, 311, 331
See application file for complete search history.

(56) References Cited

U.S. PATENT DOCUMENTS 4,369,488 A * 1/1983 Brun ..... 362/521
4,517,630 A * 5/1985 Dieffenbach et al. ..... 362/509
6,547,428 B1 * 4/2003 Delattre ..... 362/511

* cited by examiner

*Primary Examiner*—John Anthony Ward
*Assistant Examiner*—Guiyoung Lee
(74) *Attorney, Agent, or Firm*—Young & Thompson

(57) ABSTRACT

A device for masking automobile vehicle headlights comprises at least one transparent optical element (B) inserted on the path of light rays between lighting sources and the headlight glass, the optical element (B) comprising a cylindrical entry face ($E_3$) with radius R and a cylindrical exit face ($E_4$) with radius R symmetrical to the entry face ($E_3$) about a vertical median plane located at a distance 2R from the entry face ($E_3$) and the exit face ($E_4$), a mask (C) being placed in the vertical median plane and offset from the horizontal plane of symmetry.

12 Claims, 2 Drawing Sheets

MASKING DEVICE FOR AUTOMOBILE VEHICLE HEADLIGHTS

BACKGROUND OF THE INVENTION

The invention relates to headlights for automobile vehicles.

Glass on the front of automobile headlights now covers several means, at least the dip lights and headlights with various electrical sources surrounded by individual reflectors. The result is a very technical, inaesthetic appearance which has a negative influence on the general perception of the outline of the vehicle.

DESCRIPTION OF THE RELATED ART

GB-A-708 713 describes anti-glare filters for automobile lights. This type of anti-glare filter is composed of a transparent support provided on one side with a grill-shaped screen with several areas permeable to light in the form of parallel strip, separated by similar shaped opaque areas, and on the other side with a lens screen with convex lens elements each corresponding to an adjacent pair of areas permeable to light and opaque in the grill-shaped screen, the lens screen being positioned such that the focal points of the lens elements on the grill side of the screen lie within the thickness of this grill screen. A second lens screen can also be provided and another transparent support can be placed in front of the grill screen. This type of device can limit glare from headlights by masking all rays slanting upwards. This type of anti-glare device cannot be used to make a vehicle headlight that acts as dip light and headlight at the same time.

SUMMARY OF THE INVENTION

This invention is designed to eliminate or at least strongly attenuate visibility from the outside of the lighting means covered by the glass of an automobile vehicle headlight, and possibly also provide a coloured appearance matching the colour of the bodywork.

To achieve this purpose, the purpose of the invention is a device for masking automobile vehicle headlights, characterised in that it comprises at least one transparent optical element inserted on the path of light rays between the lighting sources and the glass of the headlight, a mask being placed in an approximately vertical median plane of the said optical element and at a distance from the horizontal plane of symmetry of the said element.

According to a first embodiment of the invention particularly well adapted to headlights, in which the protective glass has a vertical generating line, the said optical element comprises a cylindrical entry face with radius R and a cylindrical exit face with radius R symmetrical to the entry face about a vertical median plane located at a distance 2R from the entry and exit faces, the mask being located in the said vertical median plane and at a distance from the horizontal plane of symmetry.

The device according to the invention forms an afocal optical system producing an inversion of the image of the light source after concentration at the focus of the lens formed in this way. When the headlight is looked at from the outside under a normal angle of vision, the inside of the headlight is closed off by the mask and the resulting appearance is that of an opaque glass.

According to one variant embodiment of the invention, the mask is coloured, and preferably the same colour as the vehicle bodywork.

Advantageously, in order to avoid inversion of the image and so that the device can be used on an existing headlight, the invention allows for the optical elements to be adjacent to an identical optical element without a mask.

Preferably, the optical element or elements have plane faces orthogonal to the cylindrical entry and exit faces. Preferably, at least the plane faces are polished.

According to a second embodiment of the invention, the optical element is composed of a tubular element with a horizontal generating line comprising a converging lens at the entry end of the said tubular element extending transverse to the said tubular element, and a converging lens extending in a plane parallel to the plane of the headlight protective glass at the exit end of the said tubular element, the focus of the said lens being located on the mask.

This embodiment can advantageously produce a result similar to that obtained with the first embodiment, but for headlights for which the protective glass has a strongly inclined generating line.

BRIEF DESCRIPTION OF THE DRAWINGS

The invention will be better understood after reading the following description of example embodiments with reference to the attached drawings in which.

DESCRIPTION OF THE PREFERRED EMBODIMENTS

Figure 1:
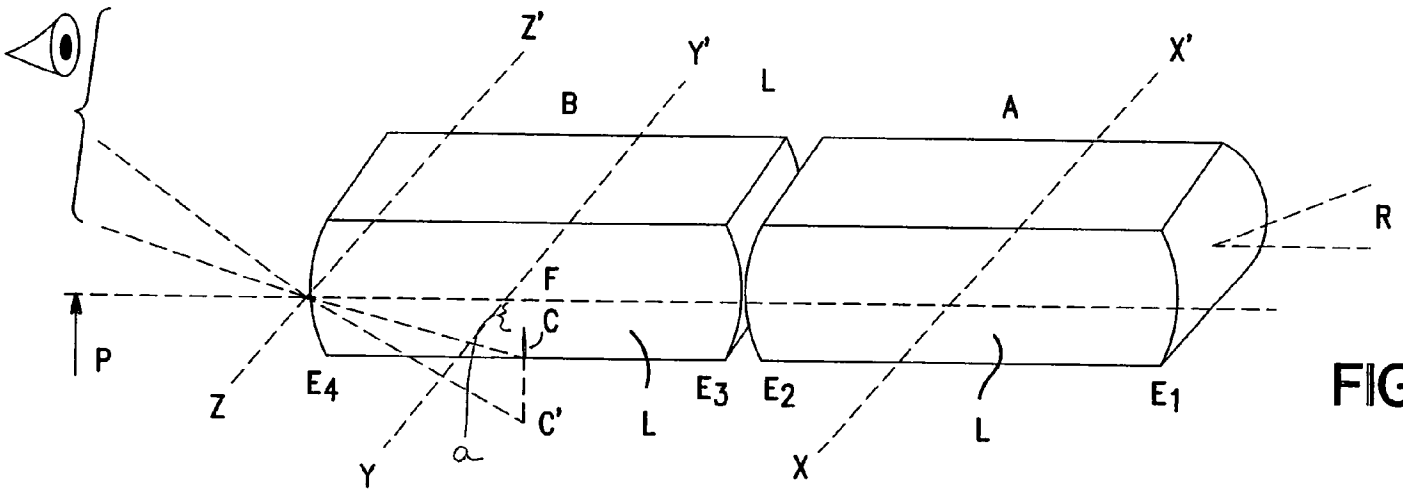
FIG. 1 is a diagrammatic perspective view of a device according to an example embodiment of the invention.

The device shown in FIG. 1 is composed of two lenses A and B adjacent to each other and arranged in this order between light sources (not shown) of the headlight and the glass (also not shown) of this headlight.

The lens A has a cylindrical entry face $E_1$ with radius of curvature R and an exit face $E_2$ with an equal radius of curvature symmetric to face $E_1$ about the vertical median plane of the lens, passing through the median horizontal axis XX'. The distance between this axis XX' and the vertices of faces $E_1$ and $E_2$ is equal to 2R. The lens A also comprises four side faces L that are plane and preferably polished.

The lens A produces a simple inversion of the image of the light sources of the headlight and forms an afocal system.

Lens B is identical to lens A, but comprises a mask C in its vertical median plane, which is offset from the horizontal plane of symmetry of the lens. The mask C may for example be composed of an insert around which the lens is moulded, and which is preferably coloured at least on the side facing the glass. The light rays output from lens A through face $E_2$ penetrate into lens B through face $E_3$ and exit from lens B through face $E_4$ after being inverted once again. Therefore the image of light sources at infinity P is identical to the image that would be obtained if the device composed of lenses A and B is not inserted.

In the case of original headlight equipment, only lens B is necessary by adapting the distribution of beams from different light sources symmetrically about a horizontal plane.

Mask C is placed at a distance a from the horizontal plane of symmetry which, when related to the distance MF between the vertex of the exit face $E_4$ and the vertical plane of symmetry, defines the angle at which the emerging rays are visible and efficient. In a view above the plane passing through the vertex M and the end of the mask C, only the mask C and the horizontal faces L are visible. The image of the mask C reflected in the polished horizontal face L is also seen, which emphasizes the opaque and preferably coloured appearance seen by an observer looking at the headlights when they are switched off, from above the plane concerned.

Figure 2:
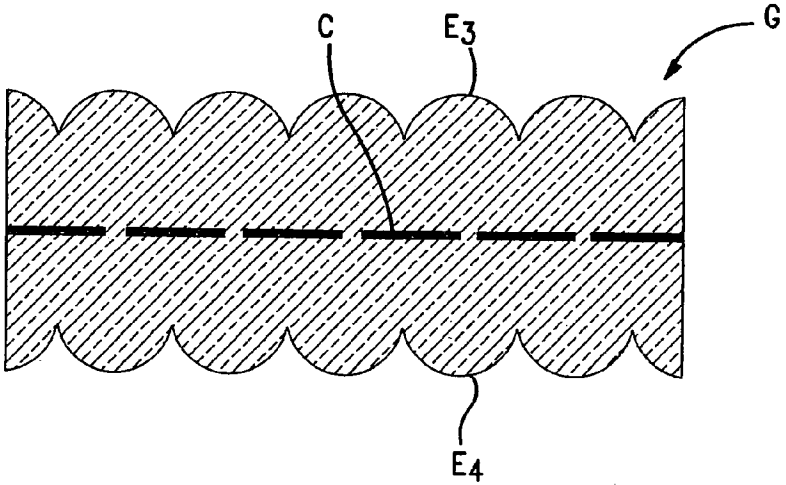
FIG. 2 is a diagrammatic view of a vertical section of a variant part of the device in FIG. 1.

Lens B, with or without lens A, may be duplicated to cover a large part of the aperture of the headlight. A large number of lenses B may be made from a single linear part as shown in FIG. 2. If necessary, the bar G thus formed may be curved.

The plane faces seen by the observer may also be coloured.

Figure 3:
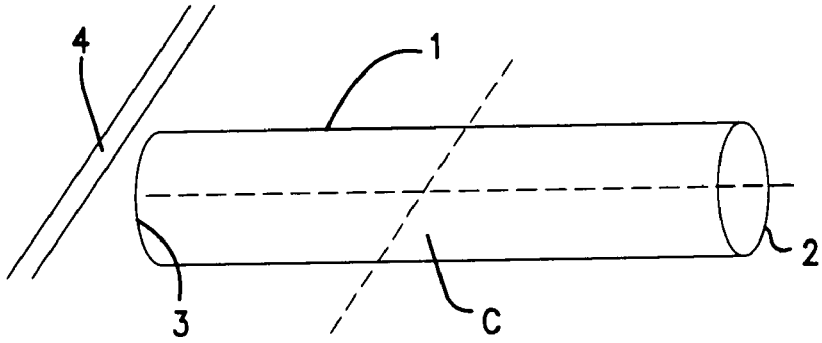
FIG. 3 shows a sectional view of a second embodiment of the invention.

FIG. 3 presents a second embodiment of the invention in which the optical element is composed of a tubular element with a horizontal generating line 1 with a converging lens 2 at the entry face of the optical element and a second converging lens 3 at its exit face. The mask C is installed approximately in the vertical median plane and away from the horizontal plane of symmetry of the optical element thus formed, the said mask C being in the focal plane of lens 3.

The first lens 2 extends transversely to tube 1 while the exit lens 3 is installed inclined with respect to tube 1 so that it is in a plane parallel to the plane of the headlight protective glass 4. The focal point of the lens 3 is on the mask C. Therefore this lens 3 is defined with respect to the protective glass 4 of the headlight and with respect to its focal plane. The lens 2 is chosen to have the appropriate focal distance. The lens 2 may have a surface that is not a surface of revolution.

Figure 4:
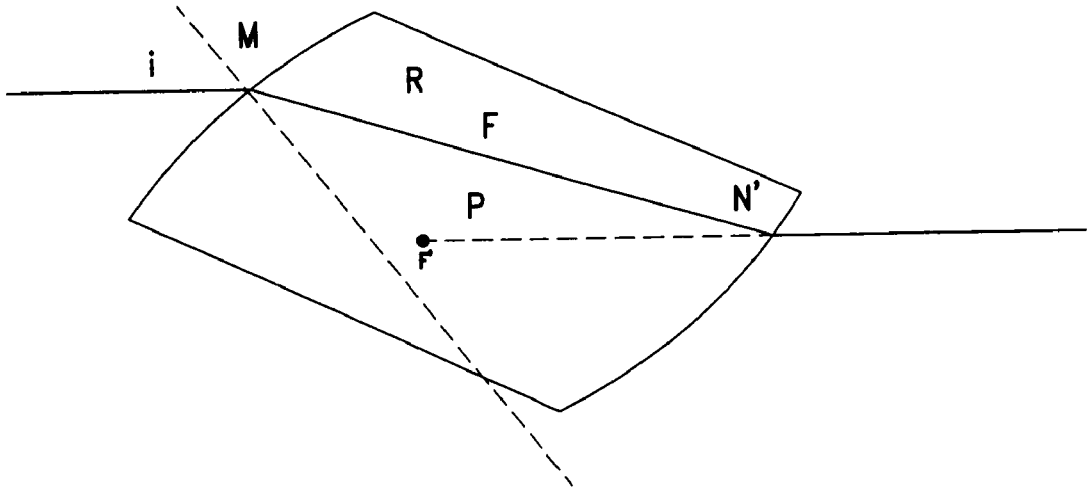
FIG. 4 shows a sectional view of an alternate form of the embodiment of the FIG. 3.

As a modification of this embodiment, it is also possible to provide an improved embodiment (see FIG. 4). The transparent optical element may be constituted by an inlet diopter A' disposed (not shown) adjacent the glass and having its shape. The straight line XX' would be the normal to the surfaced of the diopter A' at a point M. The pencil of maximum density of the exit beam forms an angle i with the normal XX', said pencil corresponding to a pencil MR in the mass of the element.

This element is defined by a surface generated by straight lines parallel to MR, the pencil emanating from the point F of a focal line and this element being prolonged at RN to a diopter by which the beam of the projectors enters. A cross-section on the plane XX' of this element is a diopter of focus F' symmetrical to the point of the focal line relative to a point P.

What is claimed is:

1. Device for masking automobile vehicle headlights, comprising:

at least one transparent optical element (B) inserted on the path of light rays between a lighting source and glass of the headlight, and a mask (C) placed in an approximately vertical median plane of said optical element (B) at a distance from a horizontal plane of symmetry of said optical element (B), wherein said optical element (B) is a lens moulded around said mask (C), characterised in that said optical element (B) comprises a cylindrical entry face ($E_3$) with radius R and a cylindrical exit face ($E_4$) with radius R symmetrical to the entry face ($E_3$) about a vertical median plane located at a distance 2R from the entry face ($E_3$) and the exit face ($E_4$), a mask (C) being located in the vertical median plane and at a distance from the horizontal plane of symmetry.

2. Device according to claim 1, characterised in that the mask (C) is the same colour as a vehicle bodywork.

3. Device according to claim 1, characterised in that the optical element (B) is adjacent to an identical optical element (A) without a mask (6).

4. Device according to claim 1, characterised in that there are at least two optical elements and the optical elements (B, A) have plane faces (L) orthogonal to the cylindrical entry faces ($E_3$, $E_1$) and exit faces ($E_4$, $E_2$).

5. Device according to claim 4, characterised in that at least the plane faces (L) are polished.

6. Device according to claim 4, characterised in that the plane faces (L) are coloured.

7. Device according to claim 1, characterised in that the optical element (B, A) is associated with several identical optical elements (B, A).

8. Device according to claim 7, characterised in that the optical elements (B, A) are associated in the form of straight or curved bars (G).

9. Device for masking automobile vehicle headlights, comprising:

at least one transparent optical element (B) inserted on the path of light rays between a lighting source and glass of the headlight, and a mask (C) placed in an approximately vertical median plane of said optical element (B) at a distance from a horizontal plane of symmetry of said optical element (B), wherein said optical element (B) is a lens moulded around said mask (C), characterised in that the optical element is composed of a tubular element (1) with a horizontal generating line comprising a converging lens (2) at the entry end of said tubular element (1) extending transversely to said tubular element (1), and a converging lens (3) extending in a plane parallel to the plane of the headlight protective glass (4) at the exit end of said tubular element (1), the focal point of said lens (3) being located on the mask (C).

10. Device for masking automobile vehicle headlights, comprising:

a lens formed by adjacent first and second lenses (A, B) arranged with the first lens (A) facing a light source of a headlight and glass of the headlight, the first lens (A) having a cylindrical entry face (E1) with radius of curvature (R) and an exit face (E2) with an equal radius of curvature symmetric to the entry face (E1) about a vertical median plane of the lens, passing through a median horizontal axis (XX'), a distance between the median horizontal axis (XX') and vertices of the entry and exit faces (E1, E2) being equal to twice the radius of curvature, the first lens (A) comprising four planar side faces (L), the first lens (A) set to produce a simple inversion of an image of the light source of the headlight, the second lens (B) having a cylindrical entry face (E3) with radius of curvature (R) and an exit face (E4) with an equal radius of curvature symmetric to the entry face (E3) about a vertical median plane of the lens, passing through a median horizontal axis (XX'), a distance between the median horizontal axis (XX') and vertices of the entry and exit faces (E3, E4) being equal to twice the radius of curvature, the second lens (B) comprising four planar side faces (L), the second lens (B) comprising a mask (C) in a vertical median plane of the second lens (B), the mask (C) being offset from the horizontal plane of symmetry of the second lens (B), the mask (C) comprising an insert around which insert the second lens is moulded.

11. Device for masking automobile vehicle headlights, comprising:

a lens formed by adjacent first and second lenses (A, B) arranged with the first lens (A) facing a light source of a headlight and glass of the headlight, each of the first lens (A) and the second lens (B) having a cylindrical entry face (E1, E3) with radius of curvature (R) and an exit face (E2, E4) with an equal radius of curvature symmetric to the entry face (E1, E3) about a vertical median plane of the lens, passing through a median horizontal axis (XX'), the second lens (B) further comprising a mask (C) in a vertical median plane of the second lens (B), the mask (C) being offset from the horizontal plane of symmetry of the second lens (B), the mask (C) comprising an insert around which insert the second lens is moulded.

12. Device of claim 11, wherein, a distance between the median horizontal axis (XX') and vertices of the entry and exit faces are equal to twice the radius of curvature, the first and second lenses comprising four planar side faces (L), and each of the first and second lenses are set to produce a simple inversion of an image of the light source of the headlight.

* * * * *